US007761192B2

(12) United States Patent
Lo

(10) Patent No.: US 7,761,192 B2
(45) Date of Patent: Jul. 20, 2010

(54) COMPLEX SIGNAL PROCESSING SYSTEM AND RELATED METHOD FOR CONTROLLING MULTIPLE FANS

(75) Inventor: Ching-Yu Lo, Taipei (TW)

(73) Assignee: Tyan Computer Corp., Taipei (TW)

( * ) Notice: Subject to any disclaimer, the term of this patent is extended or adjusted under 35 U.S.C. 154(b) by 812 days.

(21) Appl. No.: 11/636,492

(22) Filed: Dec. 11, 2006

(65) Prior Publication Data

US 2008/0074065 A1 Mar. 27, 2008

(30) Foreign Application Priority Data

Sep. 21, 2006 (TW) ..... 95135026 A

(51) Int. Cl.

| | |
|---|---|
| ***G05D 13/00*** | (2006.01) |
| *G05B 15/00* | (2006.01) |
| *H02P 7/08* | (2006.01) |
| *H02P 5/46* | (2006.01) |
| *G01P 1/10* | (2006.01) |
| *H01H 47/00* | (2006.01) |

(52) U.S. Cl. ..... 700/304; 700/1; 318/67; 318/68; 318/69; 318/77; 361/236

(58) Field of Classification Search ..... 700/1, 700/304; 702/189; 324/676, 683, 709, 710; 361/236; 318/67–69, 77

See application file for complete search history.

(56) References Cited

U.S. PATENT DOCUMENTS

| | | | | |
|---|---|---|---|---|
| 6,545,438 | B1 * | 4/2003 | Mays, II | 318/400.01 |
| 7,275,533 | B2 * | 10/2007 | Soeholm et al. | 126/299 R |
| 2003/0063437 | A1 * | 4/2003 | Kurihara | 361/688 |
| 2003/0126473 | A1 * | 7/2003 | Maciorowski et al. | 713/300 |
| 2003/0201741 | A1 * | 10/2003 | Lee | 318/268 |
| 2004/0153786 | A1 * | 8/2004 | Johnson et al. | 714/25 |
| 2004/0185770 | A1 * | 9/2004 | Soeholm et al. | 454/239 |
| 2005/0024828 | A1 * | 2/2005 | Espinoza-Ibarra et al. | 361/695 |
| 2005/0049729 | A1 * | 3/2005 | Culbert et al. | 700/50 |
| 2005/0211426 | A1 * | 9/2005 | Ziarnik et al. | 165/287 |
| 2006/0168975 | A1 * | 8/2006 | Malone et al. | 62/180 |
| 2007/0292257 | A1 * | 12/2007 | Ooi et al. | 415/1 |

* cited by examiner

*Primary Examiner*—Ramesh B Patel
(74) *Attorney, Agent, or Firm*—Bacon & Thomas, PLLC

(57) ABSTRACT

A complex signal processing system for multiple fans is used to control the rotation of a first fan and a second fan. The speed signals of the first fan and the second fan are processed through an XOR operation to obtain a complex speed signal. In response to the complex speed signal, the speed and the operational status of the first fan and the second fan can be evaluated.

17 Claims, 5 Drawing Sheets

COMPLEX SIGNAL PROCESSING SYSTEM AND RELATED METHOD FOR CONTROLLING MULTIPLE FANS

BACKGROUND OF THE INVENTION

1. Field of the Invention

The present invention relates a cooling technology for electronic products, and, more particularly, to a complex signal processing system and related method for controlling multiple fans.

2. Description of the Related Art

With the rapid pace of improvements in semiconductor technologies, the number of transistors in a single integrated circuit (IC) has increased dramatically, and the execution speeds of integrated circuits have also seen dramatic increases. As a result, it has become very important to improve the cooling capabilities for these integrated circuits.

FIG. 1 is a schematic drawing of a fan control module in the prior art. The hardware monitor 110 uses TACH pins 1~4 to receive and process fan speed signals (tachometer signals). The hardware monitor 110 has specific fan control pins for sending pulse width modulation (PWM) signals to control the speed of the fans. However, the number of pins available for the hardware monitor 110 is limited, and when there are more fans, more hardware monitors are required. When the pins for the hardware monitor 110 are insufficient, even the addition of a single fan requires the addition of another hardware monitor. As shown in FIG. 1, hardware monitors 110, 120 each have four pairs of fan control pins; the fans 131, 132, 133, 134 are controlled by the hardware monitor 110, and a single fan 135 is controlled by the hardware monitor 120. Therefore, under this configuration, the additional hardware monitor 120 occupies space on the motherboard with extra fan control pins unused.

It is therefore desirable to provide a complex signal processing system and related method for controlling multiple fans to mitigate and/or obviate the aforementioned problems.

SUMMARY OF THE INVENTION

A main objective of the present invention is to provide a complex signal processing system and related method for controlling multiple fans, which can avoid too many hardware control circuit to save space and cost. According to an aspect of the present invention, a complex signal processing system for controlling a plurality of fans comprises: at least a first fan and a second fan, at least a logic gate, a hardware monitor and a control device. The first fan and the second fan separately have an output pin for outputting a speed signal indicating the rotational speed of the first fan or the second fan. The logic gate is connected to the respective output pins of the first fan and the second fan, for executing a logical operation upon the speed signal of the first fan and the speed signal of the second fan to generate a complex speed signal. The hardware monitor is connected to the logic gate, for receiving the complex speed signal and converting the complex speed signal into complex digital speed data. The control device is coupled to the hardware monitor for receiving the complex digital speed data and calculating a rotational speed of the first fan and the second fan according to the complex digital speed data.

According to another aspect of the present invention, complex signal processing method for a plurality of fans including at least a first fan and a second fan, the method comprises: step A: separately driving the first fan and the second fan by at least one control signal to control their rotational speed; step B: executing a logical operation to a speed signal of the first fan and a speed signal of the second fan to generate a complex speed signal; and step C: converting the complex speed signal into complex digital speed data.

According to an embodiment of the present invention, the method further comprises: step D: calculating the rotational speed of the first fan and the second fan utilizing the complex digital speed data; the rotational speed of the first fan and the second fan is obtained by dividing the complex digital speed data by a total number of the first fan and the second fan; and step E: determining whether the first fan and the second fan is operating normally according to the calculated rotational speed.

According to the embodiment of the present invention, the method further comprises: step F: determining whether the first fan and the second fan is operating normally according to the complex digital speed data.

According to the embodiment of the present invention, determining whether the first fan and the second fan are operating normally in step E, F comprises determining whether the rotational speed of the first fan and the second fan is less than a predetermined speed and determining whether the times the rotational speed of the first fan and the second fan is less than a predetermined speed exceed the predetermined value. If the first fan and the second fan operate abnormally, a step of generating a warning signal is performed to warn users, e.g. via an LED, a speaker, or a buzzer, etc.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
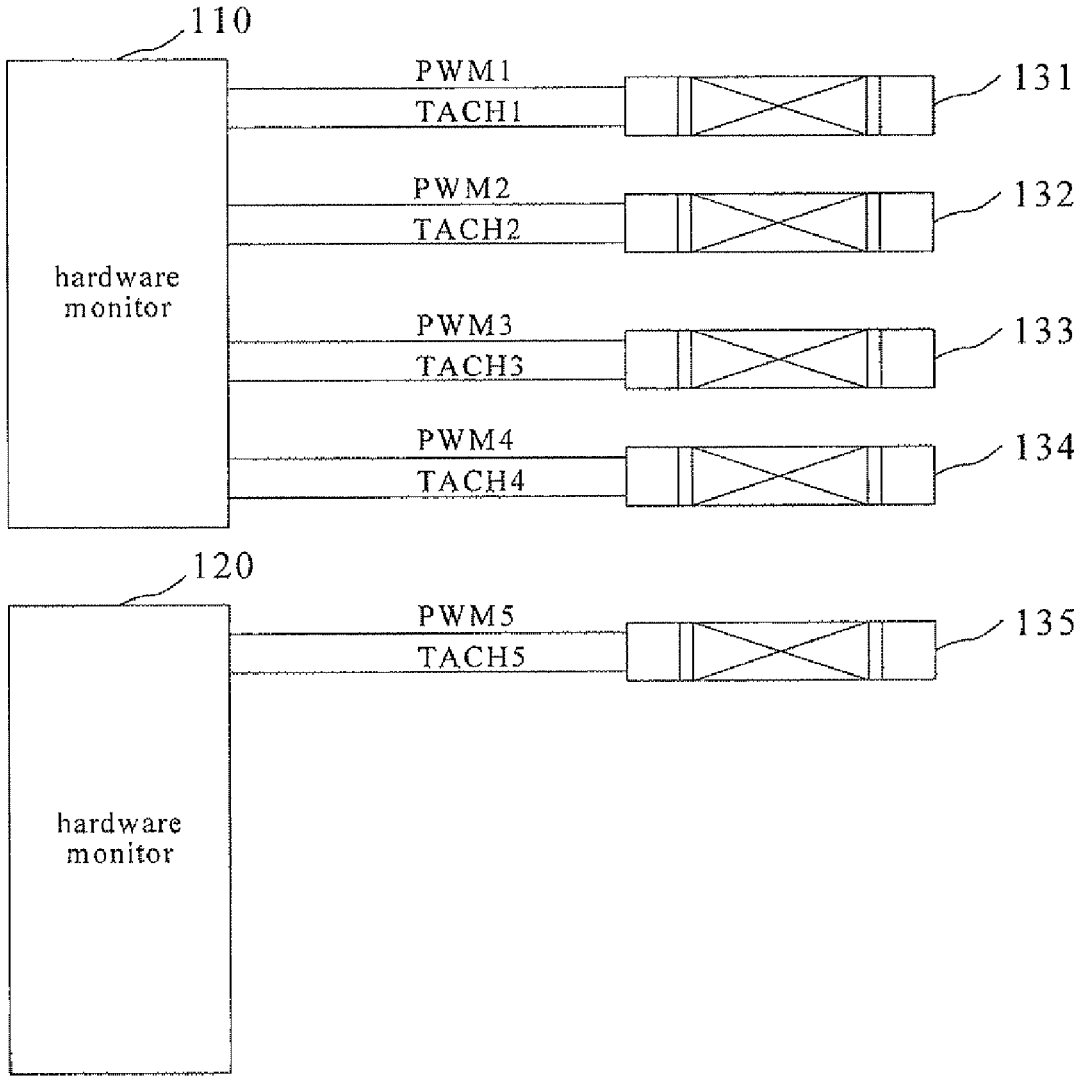
FIG.1 ( Prior Art )
FIG. 1 is a schematic drawing of a prior art fan control module.
Figure 2:
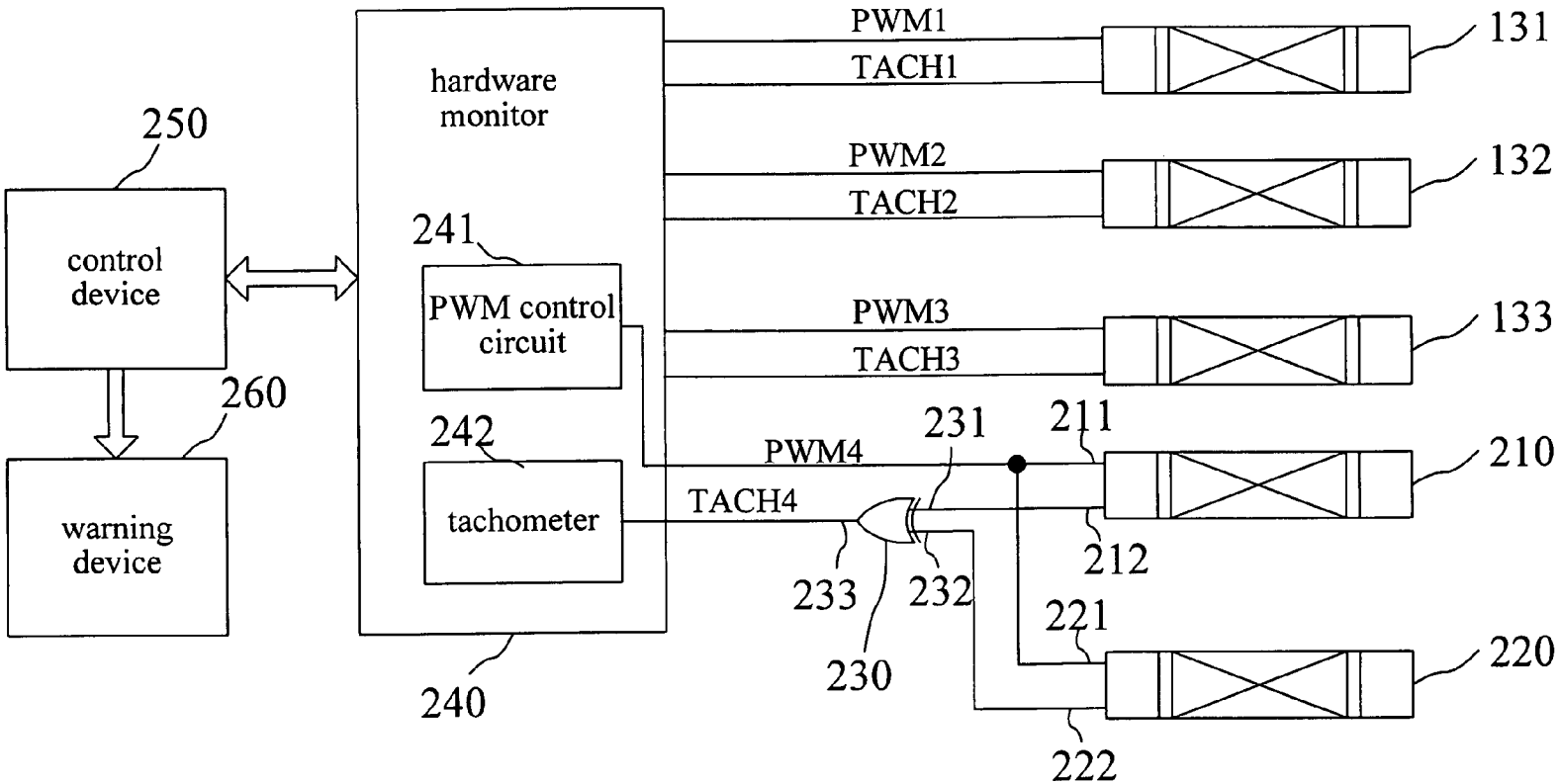
FIG. 2 is a functional block drawing of a complex signal processing system for controlling multiple fans according to the present invention.

FIG. 2 is a functional block drawing of a complex signal processing system for controlling multiple fans according to the present invention. The system comprises a first fan 210, a second fan 220, a logic gate 230, a hardware monitor 240, a control device 250 and a warning device 260.

The first fan 210 and the second fan 220 respectively have control pins 211, 221 and output pins 212, 222. The control pins 211, 221 receive a control signal PWM4 to drive and control the rotational speed of the first fan 210 and the second fan 220; the output pins 212, 222 output a speed signal indicating the rotational speed of the first fan 210 and the second fan 220. The first fan 210 and the second fan 220 preferably have rated speed characteristics, meaning that these two fans should have the same maximum average rotational speed under the same controlled environmental conditions.

A first input end 231 of the logic gate 230 is connected to the output pin 212 of the first fan 210, and a second input end 232 of the logic gate 230 is connected to the output pin 222 of the second fan 220, to execute a logical operation on the speed signal of the first fan 210 and the speed signal of the second fan 220, thereby generating a complex speed signal. The logic gate 230 is preferably an XOR gate, which can execute an XOR logical operation upon the speed signal of the first fan 210 and the speed signal of the second fan 220 to generate the complex speed signal.

The hardware monitor 240 is connected to the logic gate 230 and used for receiving the complex speed signal and converting the complex speed signal into complex digital speed data. For example, the hardware monitor 240 converts the pulse of the complex speed signal into a 16-bit digital value and stores it in a 16-bit register for being read by the control device 250. The hardware monitor 240 further comprises a PWM control circuit 241 and a tachometer 242.

The control circuit 241 is connected to the control pins 211, 221 of the first fan 210 and the second fan 220 to output a control signal PWM4 to the control pins 211, 221 of the first fan 210 and the second fan 220, thus controlling the speeds of the first fan 210 and the second fan 220. The control signal PWM4 is a pulse-width modulation (PWM) signal. Actually, the control signals PWM1, PWM2, PWM3, PWM4 may all be used for controlling the first fan 210 and the second fan 220, and under the same speed settings, the first fan 210 and the second fan 220 can be controlled by different control signals.

The tachometer 242 is connected to an output pin 233 of the XOR gate 230, receiving the complex speed signal and trigging the tachometer 242 to perform signal conversion based on the edge of the complex speed signal. The tachometer 242 converts the number of pulses of the received complex speed signal in a unit of time into complex digital speed data, and stores the complex digital speed data in the register.

The control device 250 is coupled to the hardware monitor 240 to receive the complex digital speed data and calculate the speed of the first fan 210 and the second fan 220 based upon the complex digital speed data. The control device 250 divides the complex digital speed data by two and uses this half-value as the speed of the first fan 210 and the second fan 220. The control device 250 reads the register for the tachometer 242 regularly to obtain new complex digital speed data.

The warning device 260 is connected to the control device 250, and when the speed of the first fan and the second fan falls below a predetermined value, the control device 250 generates a warning signal and drives warning device 260 with the warning signal. The warning device 260 may be an LED, which generates a visual warning signal according to the warning signal. The warning device 260 can also be a speaker or a buzzer, which then generates an audio warning signal according to the warning signal.

To avoid noise interfering with the complex digital speed data received by the control device 250, the control device 250 determines whether the times the speed of the first fan and the second fan has fallen below the predetermined speed exceed a predetermined value (e.g., more than 10 times) before generating the warning signal. When the control device 250 determines that the times, in which the speed of the first fan 210 and the second fan 220 has fallen below the predetermined speed, has exceeded the predetermined value, a state indicating that the speed of the first fan 210 and the second fan 220 has fallen below the predetermined speed for a while, the control device 250 generates the warning signal.

Figure 3:
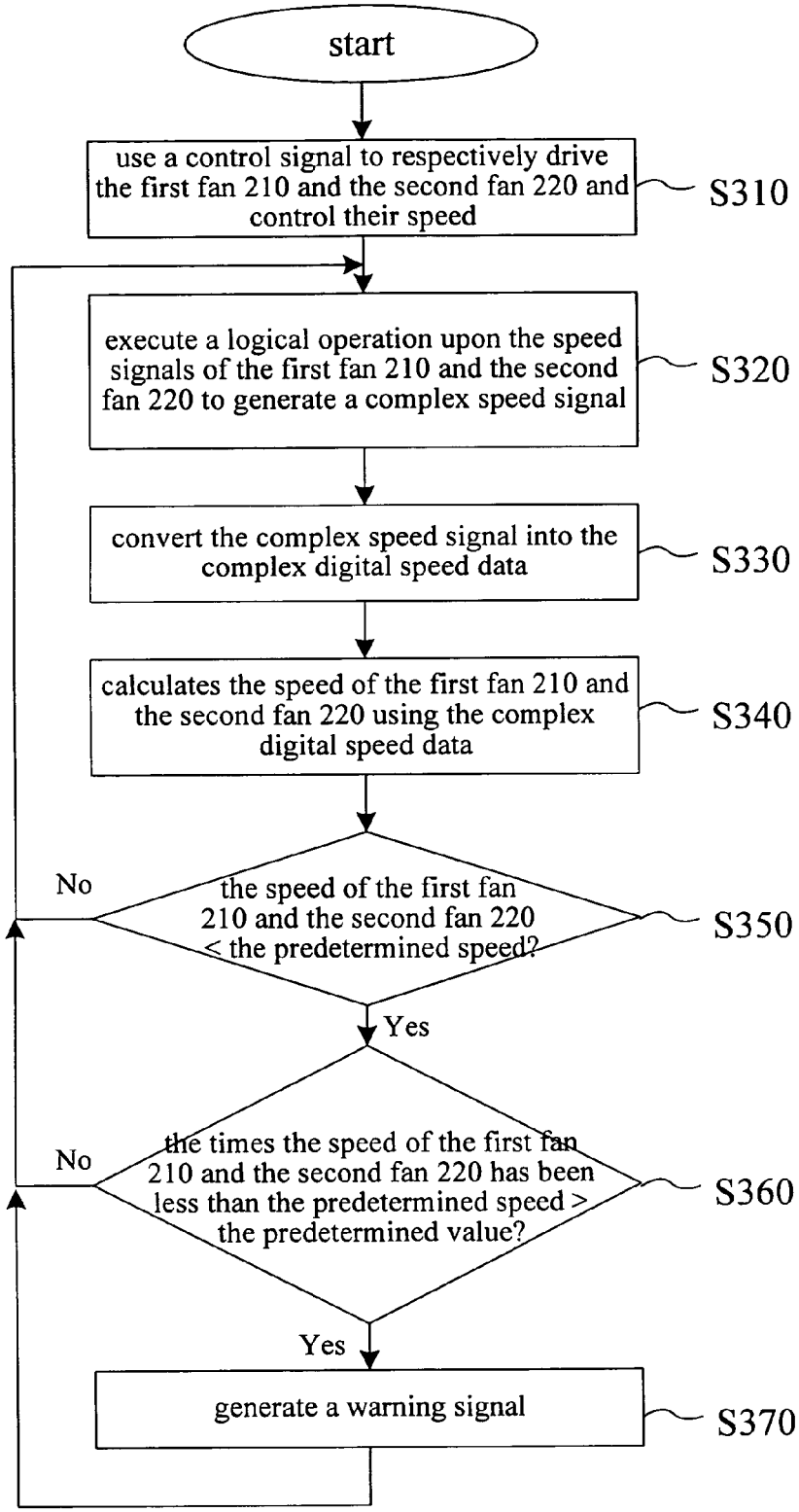
FIG. 3 is a flow chart of a complex signal processing method for controlling multiple fans according to the present invention.

Please refer to FIG. 3. FIG. 3 is a flow chart of a complex signal processing method for controlling multiple fans according to the present invention. The flow chart shows how to process the speed signal of the first fan 210 and the second fan 220. First, in step S310, the hardware monitor 240 uses at least one PWM control signal to drive the first fan 210 and the second fan 220 and to control their speed.

In step S320, the logic gate 230 is utilized to execute an XOR logical operation upon the speed signals of the first fan 210 and the second fan 220 to generate a complex speed signal.

Figures 4A, 4B:
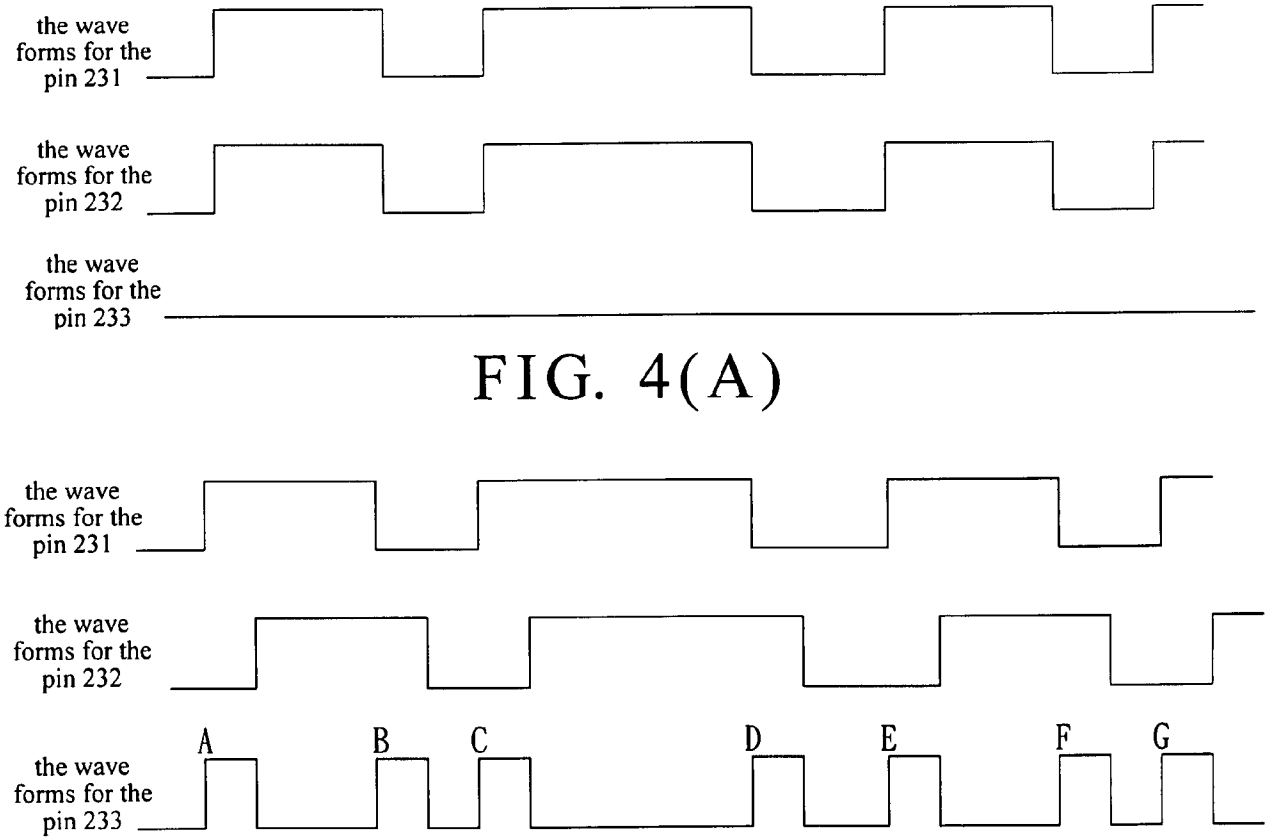
FIG. 4A is a timing diagram that shows the wave phases of two fan speed signals being identical when a logic gate executes an XOR logical operation.
FIG. 4B is a time sequence diagram that shows the wave phases of two fan speed signals being different when a logic gate executes an XOR logical operation.

Please refer to FIG. 4A and FIG. 4B. FIG. 4A is a timing diagram showing the wave phases of two fan speed signals being identical when the logic gate executes an XOR logical operation. FIG. 4B is a timing diagram showing the wave phases of two fan speed signals being different when the logic gate executes an XOR logical operation. The first fan 210 and the second fan 220 may have the same rated speed, and both may use the same PWM signal PWM4 for speed control. However, due to variables such as internal friction, mechanical variations, etc., the speed signal of the first fan 210 and the second fan 220 may have a phase offset instead of being identical to the wave phase shown FIG. 4A. The edges A~G shown in FIG. 4B can trigger the tachometer 242 to perform the signal conversion. In step S330, the hardware monitor 240 converts the complex speed signal into the complex digital speed data.

In step S340, the control device 250 calculates the speed of the first fan 210 and the second fan 220 using the complex digital speed data. The control device 250 divides the complex digital speed data into half and uses the halved value as the speed of the first fan 210 and the second fan 220. Please refer to the wave form for the pin 233, shown in FIG. 4B. For the XOR logical operation performed by the logic gate 230, the number of positive edges of the wave form of the pin 233 is substantially equal to the total number of positive edges of the wave forms for the pin 231 and the pin 232. Therefore, a halved value of the complex digital speed data may be viewed as the speed of the first fan 210 and the second fan 220. In the other words, by dividing the complex digital speed data by the total number of fans, the speed for each fan may be obtained.

In step S350, the control device 250 determines whether the speed of the first fan 210 and the second fan 220 has fallen below the predetermined speed. When the control device 250 determines that the speed of the first fan 210 and the second fan 220 is less than the predetermined speed, the control device 250 determines whether the times the speed of the first fan 210 and the second fan 220 has been less than the predetermined speed exceed the predetermined value (step S360).

In step S370, when the control device 250 determines the times the speed of the first fan 210 and the second fan 220 being lower than the predetermined speed has exceeded a predetermined value, the control device 250 generates a warning signal and drives the warning device with the warning signal. The warning signal can be a visual warning signal or an audio warning signal.

In step S350, when the control device 250 determines that the speed of the first fan and the second fan is not less than the predetermined value, step S320 is executed. In step S360, when the control device 250 determines that the times the speed of the first fan 210 and the second fan 220 is less than the predetermined speed do not exceed the predetermined value, step S320 is executed.

In step S340, it may not be necessary to divide the complex digital speed data into half to obtain the speed of the first fan 210 and the second fan 220. For example, if the complex digital speed data is 300 rev/sec, step S340 may calculate the speed of the first fan 210 and the second fan 220 to be about 150 rev/sec, and step S350 may determine whether 150 rev/sec is less than the predetermined speed (assuming, for example, that the predetermined speed is 200 rev/sec). If step S340 is skipped, step S350 can be changed to determine whether the complex digital speed data (300 rev/sec) exceeds more than twice of the predetermined speed (e.g., 400 rev/sec=2×200 rev/sec).

When the present invention is utilized for more than two fans, the speed of each fan can be obtained by dividing the complex digital speed data by the number of fans. However, when there are more than two fans, more logic gates are required, and all of speed signals should be processed by several XOR logical operations. For example, four speed signals from four fans may use three XOR gates to perform three XOR logical operations to provide the complex speed signal.

Figure 5:
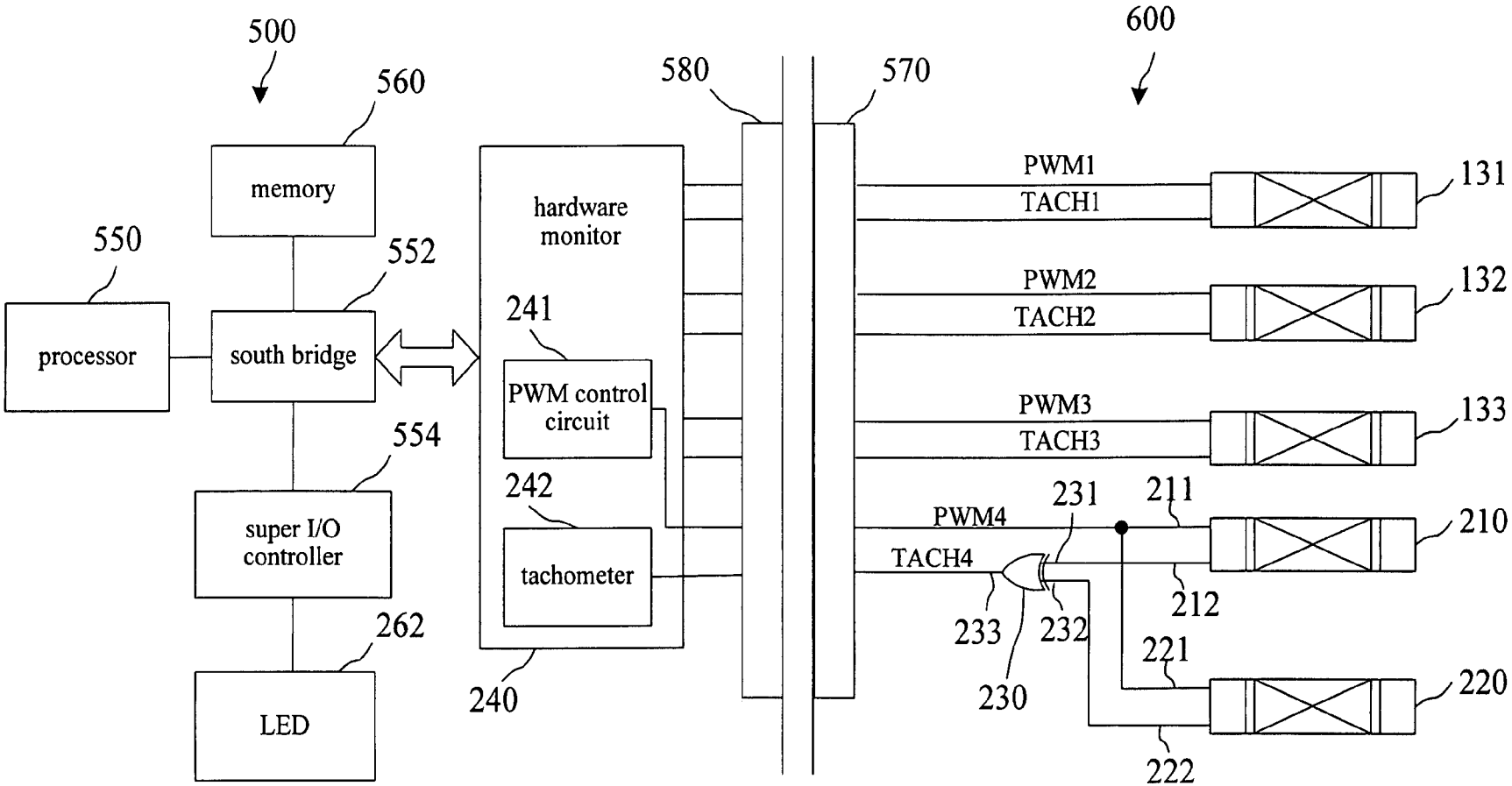
FIG. 5 is a schematic drawing of another embodiment according to the present invention.

Please refer to FIG. 5. FIG. 5 is a schematic drawing of another embodiment according to the present invention. In FIG. 5, fans 131, 132, 133, 210, 220 and logic gate 230 are all installed in a fan module 600, such as a fan switch board. The hardware monitor 240 and the warning device 260 are installed on a motherboard 500. The control device 250 is replaced by a processor 550, a south bridge 552, a memory 560 and a super I/O controller 554. The south bridge 552 reads the complex digital speed data from the hardware monitor 240 via a SM Bus; the memory 560 stores basic input output system (BIOS) program code and control programs for the fans 131, 132, 133, 210, 220, which are executed by the processor 550; the super I/O controller 554 is connected to the south bridge 552 and the LED 262. When the fans malfunction, the super I/O controller 554 controls the LED 262 accordingly. Under certain conditions, the south bridge 552 can directly control the LED 262. The fan module 600 may be connected to a connector 580 on the motherboard 500 via a connector 570, and the connectors 570, 580 can be pin headers.

In certain embodiments, the control device may be provided by an integrated circuit.

Accordingly, the present invention uses the control signal PWM4 output by the hardware monitor 240 to control the speed of the first fan 210 and the second fan 220. The logic gate 230 may used to provide an XOR logical operation to the speed signal of the first fan 210 and the second fan 220, thus reducing the pin requirements of the hardware monitor 240, which can save space and manufacturing costs.

Although the present invention has been explained in relation to its preferred embodiment, it is to be understood that many other possible modifications and variations can be made without departing from the spirit and scope of the invention as hereinafter claimed.

What is claimed is:

1. A complex signal processing system for controlling at least a first fan and a second fan, each fan having an output pin for outputting a speed signal indicating the rotational speed of the respective fan, the system comprising:

at least one logic gate connected to the respective output pins of the first fan and the second fan, for executing a logical operation upon the speed signal of the first fan and the speed signal of the second fan to generate a complex speed signal;

a hardware monitor connected to the logic gate, for receiving the complex speed signal and converting the complex speed signal into complex digital speed data; and a control device coupled to the hardware monitor for receiving the complex digital speed data and calculating a rotational speed of the first fan and the second fan by dividing the complex digital speed data by the total number of the first fan and the second fan.

2. The system of claim 1 further comprising:

a warning device connected to the control device; wherein when the rotational speed of the first fan and the second fan is less than a predetermined value, the control device generates a warning signal to drive the warning device.

3. The system of claim 1, wherein the logic gate is an XOR gate.

4. The system of claim 1, wherein the hardware monitor further comprises:

a control circuit connected to control pins of the first fan and the second fan, for outputting at least one control signal to the control pins of the first fan and the second fan to control the rotational speed of the first fan and the second fan.

5. The system of claim 4, wherein the control signal is a PWM signal.

6. The system of claim 1, wherein the hardware monitor further comprises:

a tachometer connected to an output pin of the logic gate, for receiving the complex speed signal and converting it to the complex digital speed data.

7. The system of claim 1, wherein the first fan and the second fan have a substantially identical rated speed.

8. A method for processing the rotational speed signals of at least a first fan and a second fan, the method comprising:

step A: separately driving the first fan and the second fan by at least one control signal to control the rotational speed;

step B: executing a logical operation to a speed signal of the first fan and a speed signal of the second fan to generate a complex speed signal;

step C: converting the complex speed signal into complex digital speed data; and step D: calculating the rotational speed of the first fan and the second fan by dividing the complex digital speed data by a total number of the first fan and the second fan.

9. The method of claim 8, wherein the logical operation in step B is at least one XOR logical operation.

10. The method of claim 8 further comprising:

step E: determining whether the first fan and the second fan is operating normally according to the calculated rotational speed.

11. The method of claim 10, wherein step E further comprises: determining whether the rotational speed of the first fan and the second fan is less than a predetermined speed.

12. The method of claim 10, wherein step E further comprises: determining whether the times the rotational speed of the first fan and the second fan is less than a predetermined speed exceed a predetermined value.

13. The method of claim 8 further comprising:

step F: determining whether the first fan and the second fan is operating normally according to the complex digital speed data.

14. The method of claim 13, wherein step F further comprises: determining whether the rotational speed of the first fan and the second fan is less than a predetermined speed.

15. The method of claim 13, wherein step F further comprises: determining whether the times the rotational speed of the first fan and the second fan is less than a predetermined speed exceed a predetermined value.

16. The method of claim 13, wherein if in step F the first fan and the second fan operate abnormally, a step of generating a warning signal is performed.

17. The method of claim 8, wherein the first fan and the second fan have substantially the same rated speed.

* * * * *